US006763976B2

(12) United States Patent
Mitchell et al.

(10) Patent No.: US 6,763,976 B2
(45) Date of Patent: Jul. 20, 2004

(54) ANTI RUN-ON DEVICE FOR REFRIGERATOR WATER DISPENSER

(75) Inventors: Alan Joseph Mitchell, Evansville, IN (US); Allan R. Steinkuhl, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 287 days.

(21) Appl. No.: 10/137,950

(22) Filed: May 3, 2002

(65) Prior Publication Data

US 2003/0205585 A1 Nov. 6, 2003

(51) Int. Cl.[7] ..... B67D 1/16
(52) U.S. Cl. ..... 222/108; 222/547
(58) Field of Search ..... 222/108, 547, 222/564, 571

(56) References Cited

U.S. PATENT DOCUMENTS

| | | | | |
|---|---|---|---|---|
| 2,598,968 A | | 6/1952 | Boosey | 137/13 |
| 3,008,307 A | | 11/1961 | Linstromberg et al. | 62/340 |
| 3,416,577 A | | 12/1968 | Franz | 141/117 |
| 3,835,661 A | | 9/1974 | Krochendorfer et al. | 62/340 |
| 3,985,268 A | | 10/1976 | Wood | 222/210 |
| 4,062,480 A | | 12/1977 | Bjorklund | 222/571 |
| 4,117,861 A | | 10/1978 | Betush | 137/595 |
| 4,263,498 A | | 4/1981 | Meyers | 219/312 |
| 4,519,526 A | | 5/1985 | Hillman | 222/212 |
| 4,597,719 A | | 7/1986 | Tano | 417/317 |
| 4,651,789 A | | 3/1987 | Linstromberg | 141/360 |
| 4,742,942 A | * | 5/1988 | Dokos et al. | 222/547 |
| 4,807,086 A | | 2/1989 | Chambliss | 361/212 |
| 5,243,083 A | | 9/1993 | Cowley et al. | 568/571 |
| 5,447,254 A | | 9/1995 | Hoover et al. | 222/1 |

* cited by examiner

*Primary Examiner*—Philippe Derakshani
(74) *Attorney, Agent, or Firm*—Robert O. Rice; John F. Colligan; Stephen Krefman

(57) ABSTRACT

An anti run-on device is provided for use in a refrigeration appliance, wherein the refrigeration appliance includes a water dispenser including a water reservoir, a water conduit extending downstream from the water reservoir to a water spout, and a user operable valve positioned in the water conduit upstream of the reservoir and the water spout. The anti run-on device comprises a constriction in the conduit between the valve and the water spout, a small hole in the conduit located either at or just downstream of the constriction, and a vacuum chamber in communication with the small hole. A Venturi or knife edge effect is created when water is flowing through the conduit to evacuate the vacuum chamber, so that when the valve is closed, water between the small hole and the water spout is drawn into the vacuum chamber, thereby precluding dripping from the water spout.

22 Claims, 5 Drawing Sheets

ANTI RUN-ON DEVICE FOR REFRIGERATOR WATER DISPENSER

BACKGROUND OF THE INVENTION

The present invention relates to water dispensers, and more particularly, to a water dispenser for use with a refrigeration apparatus and including an arrangement to prevent dripping or run-on of the water dispenser.

Manufacturers of refrigerators have offered, as a feature of their product, a water dispenser mounted to the exterior of the refrigerator door. Such a water dispenser is usually combined with a water reservoir, remotely located within the refrigerated compartment, to provide ready access to chilled water without the need to open the refrigerator door. A conduit extends between the water reservoir and the water spout from which the water is directed into a vessel such as a drinking glass. A valve, typically operated by a lever arm pressed by a glass is used to control the dispensing of water.

A common problem, associated with refrigerator dispenser mechanisms, is run-on. Run-on is dripping of water from the tube while it is not in use. There are several causes of run-on. The water reservoir expands when pressurized and contracts when de-pressurized. This causes water to run for a short time immediately after removing the glass. This effect is enhanced by compressible air bubbles trapped in the water reservoir. Dissolved air in the water can come out of solution at the low pressures in the reservoir. The added volume causes run-on. Water reservoirs sometimes freeze. The expanding ice displaces water causing dripping. All of these effects are caused by a volumetric displacement of water somewhere in the dispensing system after the water valve is turned off.

SUMMARY OF THE INVENTION

The present invention provides an arrangement for preventing dripping from the water spout in a water dispenser for a refrigerator after the shut off valve has been closed. Immediately upon the shut off valve being closed, any water in the conduit from the point of the shut off valve to the water dispenser is withdrawn back into the conduit by a suction force, thereby preventing any dripping from the water spout. In an embodiment, a reservoir is provided which communicates with the conduit and which is maintained below atmospheric pressure during a flow of water through the conduit such that when the valve is closed, any water remaining in the conduit from the valve to the water spout is drawn into the reservoir area by a suction action and is held there until a further dispensing of water occurs.

In an embodiment, the invention comprises the use of a rigid plastic tube which is surrounded by a vacuum chamber. A Venturi type vacuum device is built into the plastic tube so that when water passes through it, a vacuum is created in the surrounding chamber. When the water is turned off, water flows into the vacuum chamber due to the reduced pressure. This creates a volumetric buffer for any type of run-on that may occur. The vacuum chamber may be made of a rigid material if a small buffer is desired or an elastic material for a larger buffer volume. In the rigid design, a pressure lower than the vapor pressure of water is required to create the buffer. In the elastic design, the vacuum chamber material could have some degree of shape memory. When the water is flowing, the elastic vacuum chamber collapses due to the reduced pressure inside. When the water is turned off, it would expand, creating a larger buffer volume. There should be sufficient internal volume in the dispensing conduit, in the direction of flow, downstream of the vacuum chamber, to prevent external air from entering the vacuum chamber.

DETAILED DESCRIPTION OF THE PREFERRED EMBODIMENT

The present invention relates to an anti run-on device for preventing dripping from a conduit after a liquid valve has been closed. While the invention finds particular utility in a refrigeration appliance where a water dispenser may be provided in the door of the appliance, the invention is not limited to such use and can be used in any liquid conduit positioned between a shut off valve and an open end of the conduit. However, to provide a specific example of the invention, the invention is disclosed as used in connection with a refrigeration appliance.

Figure 1:
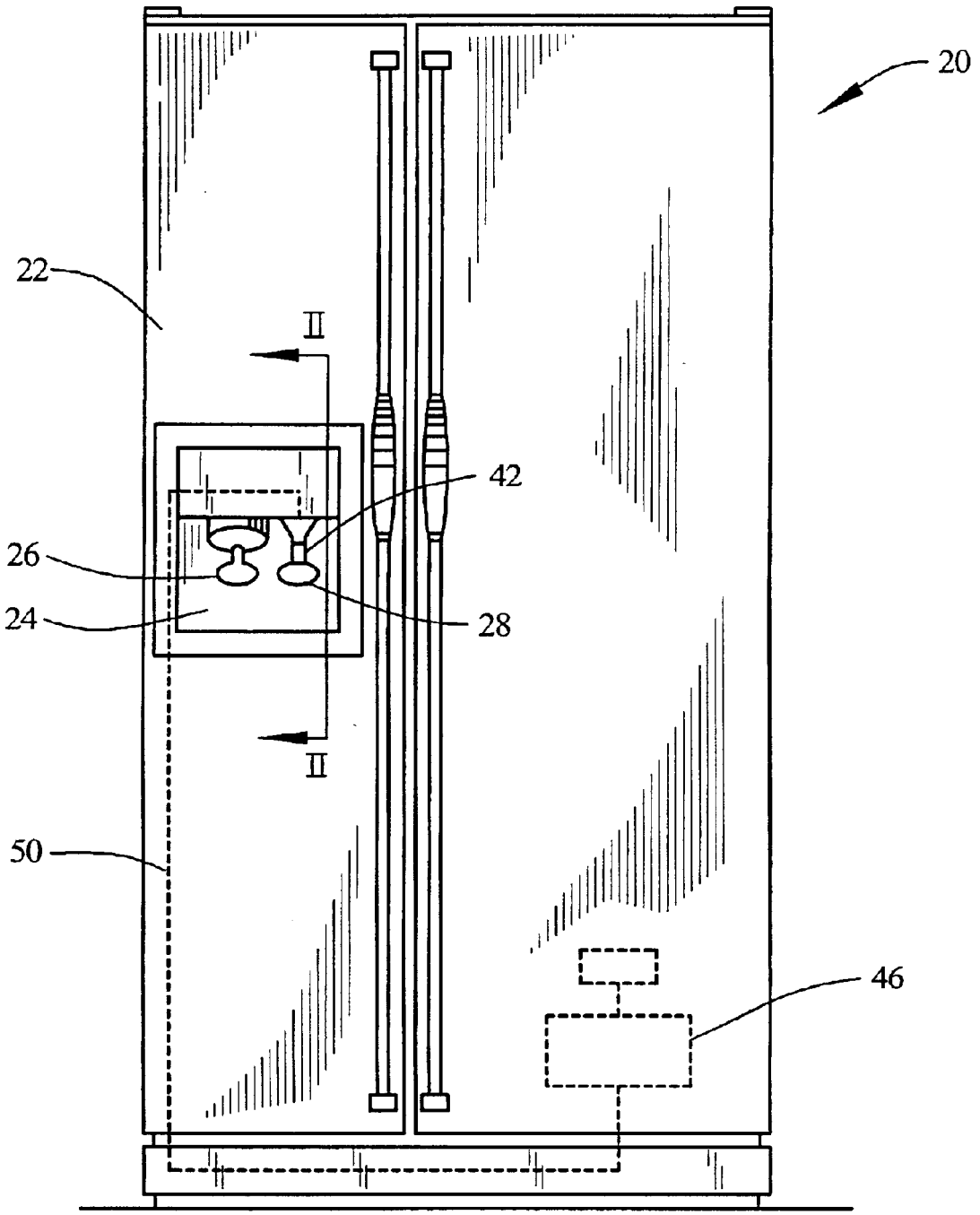
FIG. 1 is a front view of a refrigerator having a water dispenser incorporating the principles of the present invention.

Referring to FIG. 1, a refrigerator 20 is provided with a door 22 for gaining access to a below freezing compartment (not shown). Located centrally on the outer face of the door 22 is an outwardly opening housing 24 in which are mounted an ice dispenser 26 and a water dispenser 28.

Figure 2:
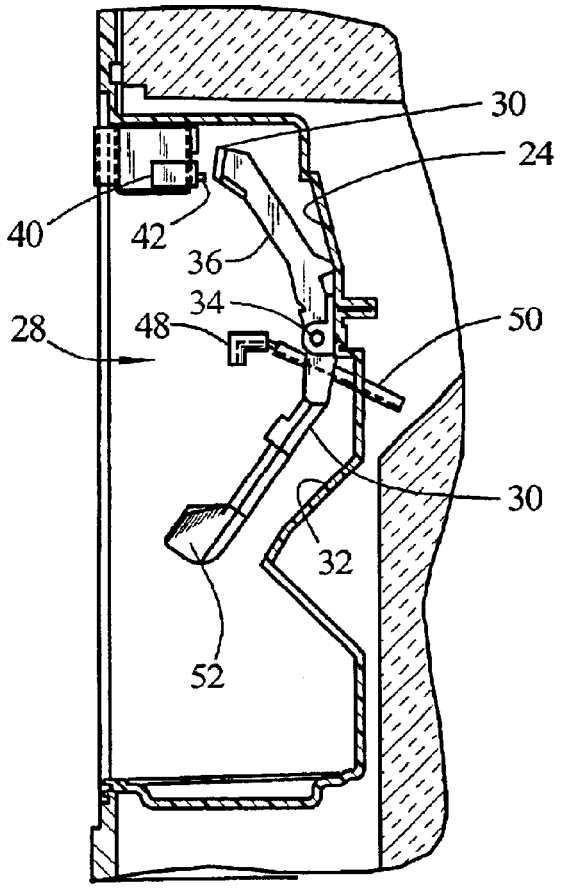
FIG. 2 is a side view of a water dispenser with which the present invention can be utilized, taken generally along the line II—II of FIG. 1.
Figure 3:
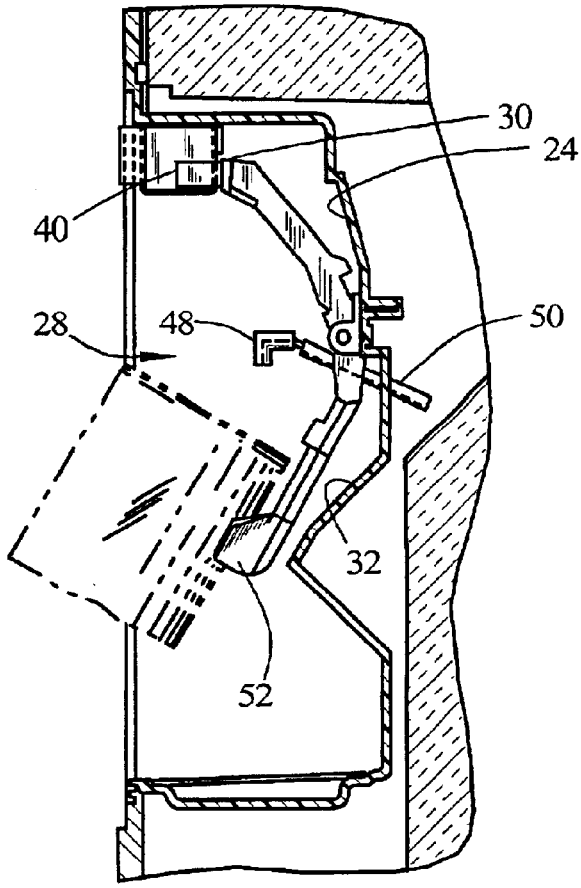
FIG. 3 is the same view as FIG. 2, but showing the water dispenser actuated by a drinking glass.

As shown in FIG. 2, the water dispenser 28 has an actuator 30 which is pivotally attached to a back surface 32 of housing 24 by a pin 34. An upper extension 36 of dispenser actuator 30 terminates in a pad 38. A dispensing switch 40 is mounted with a push button type operator 42 in alignment with the pad 38 so that when the dispenser actuator 30 is rotated counter clockwise around the pin 34, the pad 38 will actuate the operator 42, as seen in FIG. 3. A torsion spring (not shown) associated with the pin 34 biases the actuator 30 to the position shown in FIG. 2. Thus, after the actuator 30 is rotated to the position shown in FIG. 3, it will subsequently return to the position shown in FIG. 2.

Operation of the switch 40 completes an electrical circuit between a source of power and a solenoid operated valve 44 (FIG. 4) connected to a water supply. The solenoid valve 44 is also connected to a water reservoir 46 which is connected to a water spout 48 by an interconnecting tube or conduit 50. Thus, when the valve 44 is opened, pressurizing reservoir 46, water is caused to be delivered to the water spout 48.

A lower extension 52 of the actuator 30 terminates in a cradle shaped glass receiving portion 54. As illustrated in FIG. 3, the glass receiving portion 54 is configured to allow a drinking glass to be conveniently pressed against the dispenser actuator 30 and dispense water from the water spout 48, located above the glass receiving portion 54, into the glass.

Figure 4:
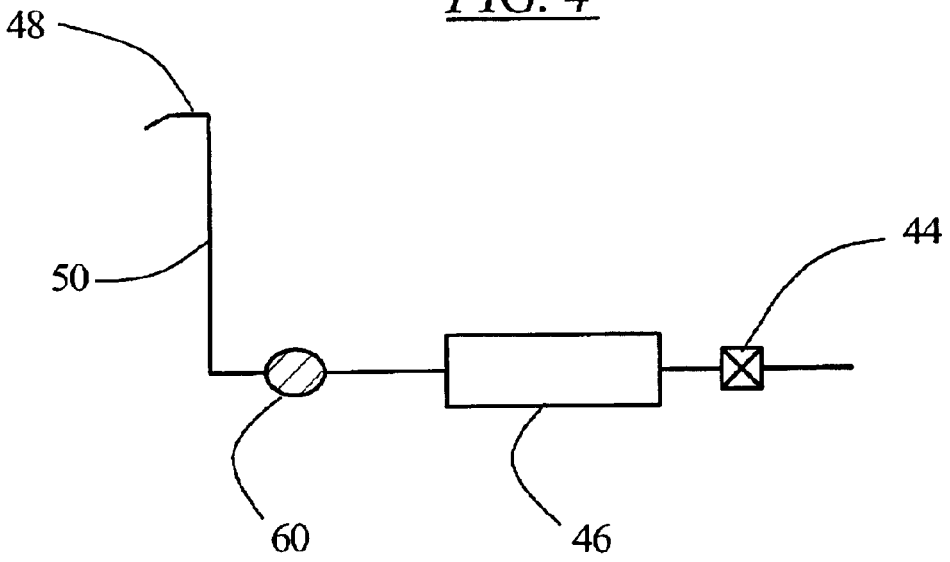
FIG. 4 is a schematic illustration of an arrangement for locating the anti-run-on device of the present invention in a water flow line.

In FIG. 4 there is schematically illustrated an improved water dispensing system incorporating the principles of the present invention. The water spout 48 is shown as being connected by the tube or conduit 50 to the water reservoir 46 and dispensing valve 44, and also including the improvement of the provision of anti run-on device 60 being positioned in the conduit 50 between the water reservoir 46 and the water spout 48.

Figure 5:
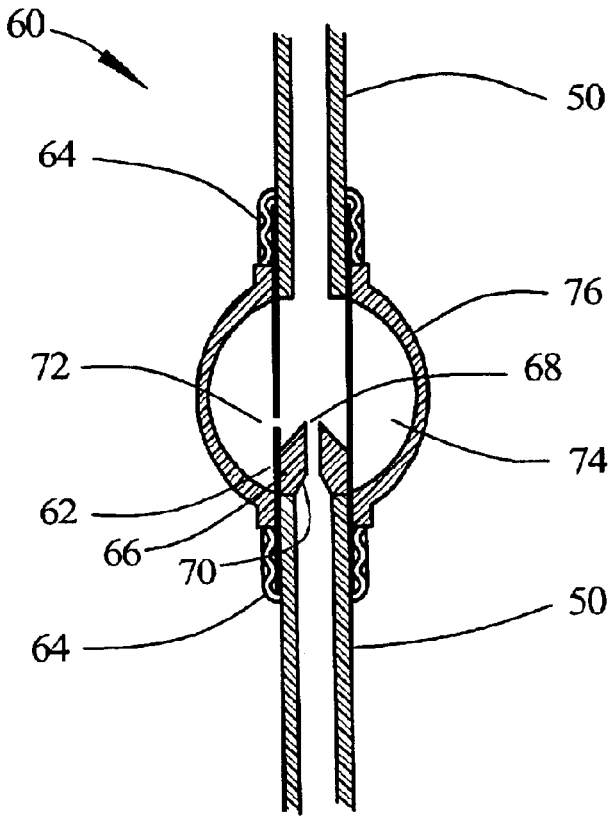
FIG. 5 is a side sectional view of an embodiment of the present invention.

In FIG. 5 there is illustrated an embodiment of the anti run-on device 60 incorporating the principles of the present invention. In this embodiment, the conduit 50 is severed and a rigid tube 62 is slipped over the severed ends of the conduit 50 and is secured thereto by appropriate fastening means such as compression nuts 64. The rigid tube 62 may be formed of any acceptable material, including appropriate plastic materials. A restrictor 66 is inserted into the rigid plastic tubing adjacent to an end of the conduit 50 which leads downwardly (in FIG. 5) to the water reservoir 46. The restrictor 66 has a reduced diameter passage 68 therethrough and may include a funnel shaped lead in opening 70 to guide the water into the passage 68. Immediately downstream of the end of the reduced diameter passage 68 the rigid tube 62 has a relatively small hole 72 formed therein. A vacuum chamber 74 formed by a vacuum chamber wall 76 surrounds the rigid plastic tube 62 and including the area including the hole 72.

As water flows from the water reservoir 46 to the water spout 48, it flows in an upward direction, in the orientation of FIG. 5, through the conduit 50 and passes through the reduced diameter passage 68. Because of the reduced diameter of the passage 68, the speed of the water flow increases and therefore the pressure decreases. This produces a reduced pressure zone in the area at the hole 72, (a Venturi effect) and thereby reduces the pressure in the vacuum chamber 74 causing any liquid in that chamber to be drawn out of the chamber and intermingled with the water stream proceeding to the water spout 48. If the vacuum chamber wall 76 is formed of a rigid materials, then preferably the passage 68 of the restrictor 66 is sized, in combination with the flow rate through the conduit, to reduce the pressure in the vacuum chamber 74 below the vapor pressure of water, so as to cause all of the water collected in the vacuum chamber 74 to be drawn through the hole 72 and into the conduit 50 as water is dispensed through the water spout 48. If the vacuum chamber wall 76 is formed of a flexible material, then the pressure in the vacuum chamber 74 only needs to be reduced to below atmospheric pressure, which will result in a collapsing of the wall 76 and a subsequent squeezing of the water out of the vacuum chamber.

When the dispensing of water is terminated by release of the actuator 30, water downstream of the restrictor 66, that is, between the restrictor and the water spout 48, is drawn by the reduced pressure in the vacuum chamber 74 through the hole 72 and into the vacuum chamber, thereby withdrawing an end of the remaining water column in the conduit 50 away from the water spout 48 and toward the anti run-on device 60. The size of the vacuum chamber 74 is selected so that it will accommodate a sufficient volume of water at the conclusion of each dispensing operation to withdraw the end of the water column in the conduit 50 far enough away from the water spout 48 such that any expansion or volumetric displacement of the water in the dispensing system after the water valve has been turned off will be insufficient to cause the end of the water column in the conduit from moving all of the way to the water spout 48. The size of the vacuum chamber 74 should also be selected so as to draw thereinto less than all of the water between the vacuum chamber and the water spout 48 so that air is not drawn into the vacuum chamber from the water spout opening.

Figure 6:
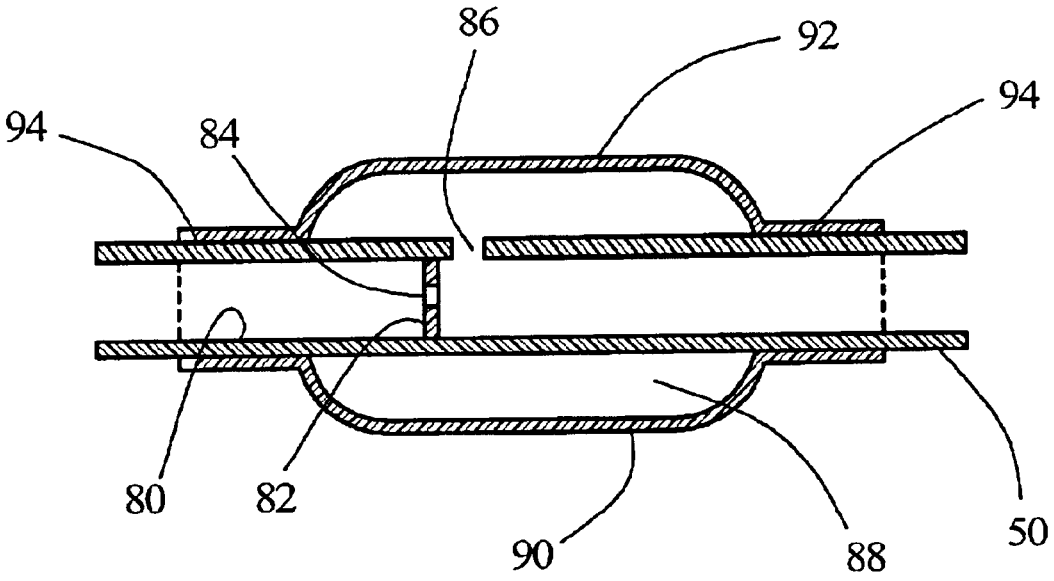
FIG. 6 is a side sectional view of an embodiment of the invention.
Figure 7:
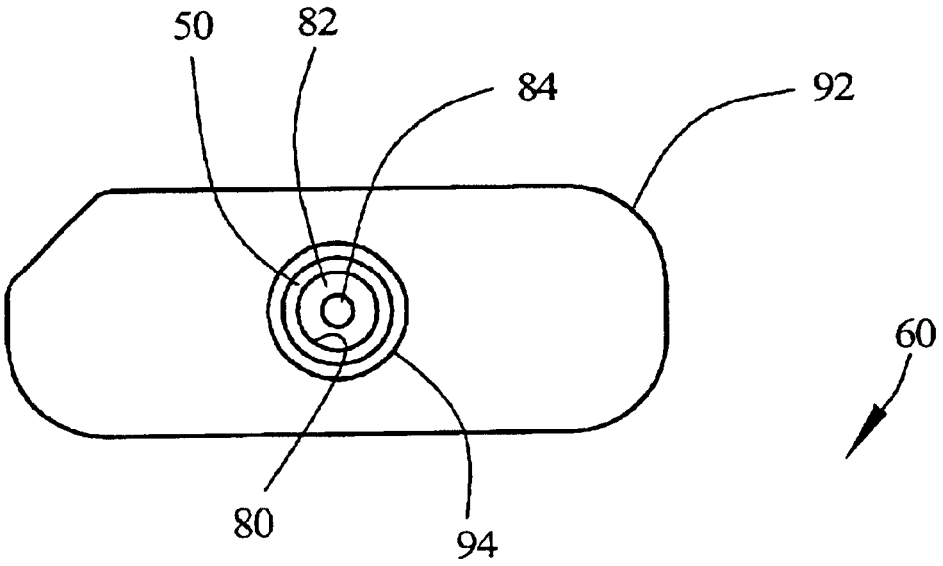
FIG. 7 is a sectional view taken generally along the line V—V of FIG. 4.

A second embodiment of the anti run-on device 60 is illustrated in FIGS. 6 and 7 in which a metal insert tube 80 is placed into the interior of the conduit 50. The insert tube 80 may be formed of metal, such as brass, or an appropriate plastic. A restrictor 82 is provided in the insert tube 80 and includes a reduced diameter opening 84 through which the water flows from the water reservoir 46 to the water spout 48 (from left to right in FIG. 6). The restrictor 82 may be an opening 84 in a disk-shaped insert, such as a flat washer, and the opening 84 creates a "knife edge" effect, reducing the pressure in the area just downstream of the restrictor. A sloped or conical lead in zone is not necessary when using a knife edge restrictor, and such a construction can be used in any of the embodiments of the anti run-on device disclosed herein. The insert tube 80, as well as the conduit 50, are provided with a hole 86 just downstream of the restrictor 82. Surrounding the insert tube 80 and conduit 50 in the area including the hole 86 is a vacuum chamber 88 formed by a vacuum chamber wall 90 (rigid or flexible as described above). The vacuum chamber wall includes a central portion 92 spaced away from the conduit 50 and end portions 94 spaced closely adjacent to the conduit 50 such that a water tight seal can be effected between the end portions 94 and the conduit 50 by appropriate means. If the conduit 50 and the vacuum chamber wall 90 are both formed of appropriate plastic materials, the end portions 94 can be sealed to the conduit 50 such as by hot staking. As in the previous embodiment, when water flows from the water reservoir 46 to the water spout 48, it passes through the opening 84 of the restrictor 82, thereby reducing pressure adjacent to the hole 86 and creating a low pressure area within the vacuum chamber 88, withdrawing any collected water therefrom into the conduit 50 for dispensing through the water spout 48. When the actuator 30 is released, thereby terminating water flow through the conduit 50, the end of the water column in the conduit 50 is drawn back toward the anti run-on device 60 in that a volume of water is drawn into the vacuum chamber 88 due to the low pressure residing therein. The same volume considerations described in the previous embodiment pertain to this embodiment as well. Hence, the volume of the vacuum chamber 88 will be determined, in part, by the distance from the anti run-on device 60 to the water spout 48 and the diameter of the conduit 50.

Figure 8:
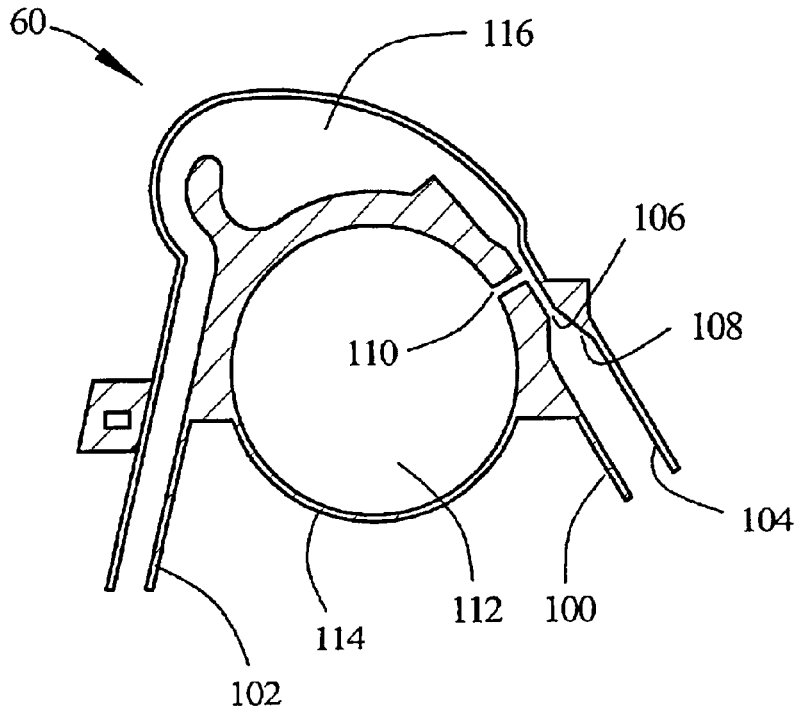
FIG. 8 is a side sectional view of a further embodiment of the present invention.
Figure 9:
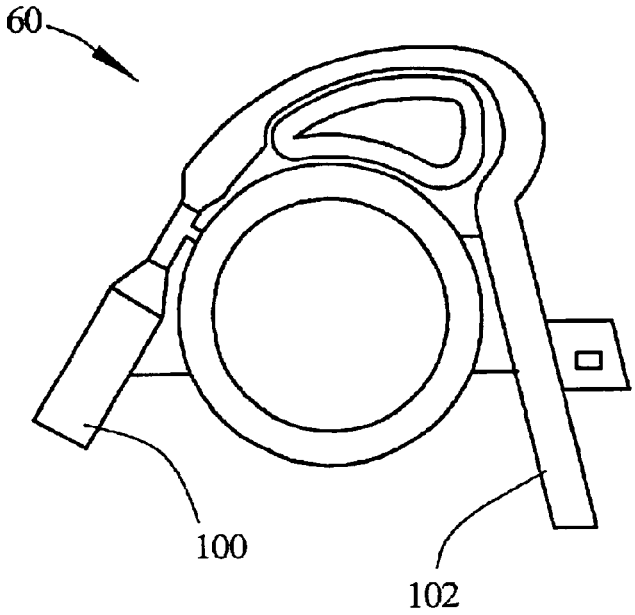
FIG. 9 is a side elevation view of an embodiment of the present invention.

In FIGS. 8 and 9 there is shown another embodiment of the anti run-on device 60. In this embodiment, the device is preferably formed as a one piece, blow molded, construction and can be made of a plastic material such as medium density polyethylene.

As seen in FIGS. 8 and 9, the anti run-on device 60 includes an inlet tube 100 for connection to the conduit 50 leading to the water reservoir 46. There is also an outlet tube 102 for connection to the conduit 50 leading to the water spout 48, or, the outlet tube 102 may comprise the water spout 48 itself. An internal diameter 104 of the inlet tube 100 is reduced to a much smaller internal diameter at a passage 106 downstream of the inlet tube 100 and the reduction in diameter can be provided by a cone shaped wall 108. Alternatively, a knife edge restrictor could be used as described above to provide the constriction in the inlet tube 100. In the reduced diameter passage 106 there is a hole 110 leading to a vacuum chamber 112 formed by vacuum chamber wall 114 (rigid or flexible as described above).

Positioned between the outlet tube 102 and the reduced diameter passage 106 is a water chamber 116 through which the water flows from the water reservoir 46 to the water spout 48 which is particularly useful when the outlet tube 102 is the water spout 48.

As in the embodiments above, when water is being dispensed, the speed of the water flow is greatly increased in the reduced diameter passage 106, thereby creating a low pressure in the area of the hole 110 and reducing the pressure within the vacuum chamber 112 so that all of the water contained therein is withdrawn through the hole 110 and dispensed along with the water flow which then passes through the water chamber 116 and the outlet tube 102 to the water spout 48. When the actuator 30 is disengaged and water through the conduit stops flowing, the water between the hole 110 leading to the vacuum chamber 112 and the water spout 48 is sucked into the vacuum chamber 112 through the hole 110 and the end of the water column is drawn away from the water spout 48. The water chamber 116 is provided in the event that the anti run-on device 60 is placed very close to the water spout 48, such as when the outlet tube 102 is the water spout. As described above, it is not desired to draw air into the vacuum chamber 112 and therefore a sufficient volume of water must be present between the vacuum chamber hole 110 and the end of the water column near the water spout 48 when flow is terminated so that the entire water column is not drawn into the vacuum chamber 112, thereby allowing air to also come into the vacuum chamber. Therefore, the water chamber 116 is dimensioned to provide a sufficient volume of water to be drawn into the vacuum chamber 112 after the flow of water is terminated so as to prevent any air from being drawn into the vacuum chamber 112. Upon the next dispensing of water, any water still remaining in the water chamber 116, as well as water drawn into the vacuum chamber 112, will be dispensed out through the outlet tube 102 and to the water spout 48.

As is apparent from the foregoing specification, the invention is susceptible of being embodied with various alterations and modifications which may differ particularly from those that have been described in the preceding specification and description. It should be understood that the scope of the patent warranted hereon is intended to include all such modifications as reasonably and properly come within the scope of the disclosed contribution to the art.

The embodiments of the invention in which an exclusive property or privilege is claimed are defined as follows:

1. An anti run-on device for use in a refrigeration appliance, wherein said refrigeration appliance includes a water dispenser including a water reservoir, a water conduit extending downstream from said water reservoir to a water spout, and a user operable valve positioned along said water conduit upstream of said reservoir and said water spout, said anti run-on device comprising:

a constriction in said conduit between said valve and said water spout;

a small hole in said conduit located one of at and just downstream of said constriction; and a vacuum chamber in communication with said small hole.

2. An anti run-on device according to claim 1, wherein said constriction is formed by a restrictor member inserted into said conduit.

3. An anti run-on device according to claim 2, wherein said restrictor member includes a passage therethrough with a diameter smaller than an interior diameter of said conduit.

4. An anti run-on device according to claim 3, wherein said passage is provided with a cone shaped lead in.

5. An anti run-on device according to claim 3, wherein said passage comprises an opening in a disk-shaped insert.

6. An anti run-on device according to claim 1, wherein said vacuum chamber is formed by vacuum chamber walls which are rigid.

7. An anti run-on device according to claim 1, wherein said vacuum chamber is formed by vacuum chamber walls which are flexible and resilient.

8. An anti run-on device according to claim 1, wherein said vacuum chamber surrounds said conduit.

9. An anti run-on device according to claim 1, further including a water chamber provided upstream of said small hole.

10. A refrigeration appliance comprising:

a water reservoir;

a water conduit extending downstream from said reservoir to a water spout and upstream of said reservoir;

a control valve positioned along said water conduit;

an anti run-on device positioned in said conduit downstream of said control valve, said anti run-on device comprising:

a constriction in said conduit;

a small hole in said conduit located one of at and just downstream from said constriction; and a vacuum chamber in communication with said small hole.

11. A refrigeration appliance according to claim 10, wherein said constriction is formed by a restrictor member inserted into said conduit.

12. A refrigeration appliance according to claim 11, wherein said restrictor member includes a passage therethrough with a diameter smaller than an interior diameter of said conduit.

13. A refrigeration appliance according to claim 12, wherein said passage comprises an opening in a disk-shaped insert.

14. A refrigeration appliance according to claim 12, wherein said passage is provided with a cone shaped lead in.

15. A refrigeration appliance according to claim 10, wherein said vacuum chamber is formed by vacuum chamber walls which are rigid.

16. A refrigeration appliance according to claim 10, wherein said vacuum chamber is formed by vacuum chamber walls which are flexible and resilient.

17. A refrigeration appliance according to claim 10, wherein said vacuum chamber surrounds said conduit.

18. A refrigeration appliance according to claim 10, further including a water chamber provided upstream of said small hole.

19. An anti run-on device for use in a liquid conduit and positioned between a shut off valve and an open end of said conduit, comprising:

a constriction in said conduit between said valve and said water spout;

a small hole in said conduit located one of at and just downstream of said constriction; and a vacuum chamber in communication with said small hole.

20. An anti run-on device according to claim 19, wherein said vacuum chamber is formed by vacuum chamber walls which are rigid.

21. An anti run-on device according to claim 19, wherein said vacuum chamber is formed by vacuum chamber walls which are flexible and resilient.

22. An anti run-on device according to claim 19, further including a water chamber provided upstream of said small hole.

* * * * *